US007694742B2

(12) United States Patent
Bane et al.

(10) Patent No.: US 7,694,742 B2
(45) Date of Patent: Apr. 13, 2010

(54) DOWNHOLE HYDRAULIC CONTROL SYSTEM WITH FAILSAFE FEATURES

(75) Inventors: Darren E. Bane, Broken Arrow, OK (US); David Z. Anderson, Glenpool, OK (US); Aaron T. Jackson, Broken Aarow, OK (US); Clifford H. Beall, Broken Arrow, OK (US); Edward W. Welch, Jr., Broken Arrow, OK (US); Alan N. Wagner, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 408 days.

(21) Appl. No.: 11/522,598

(22) Filed: Sep. 18, 2006

(65) Prior Publication Data

US 2008/0066921 A1 Mar. 20, 2008

(51) Int. Cl.
*E21B 34/16* (2006.01)

(52) U.S. Cl. ..... 166/332.1; 166/374; 251/62

(58) Field of Classification Search ..... 166/319, 166/324, 332.8, 373, 374, 332.1; 251/12, 251/339, 62, 282

See application file for complete search history.

(56) References Cited

U.S. PATENT DOCUMENTS

| | | | | |
|---|---|---|---|---|
| 3,696,868 | A | 10/1972 | Taylor, Jr. | |
| 4,341,266 | A * | 7/1982 | Craig | 166/317 |
| 4,791,990 | A * | 12/1988 | Amani | 166/311 |
| 5,971,004 | A * | 10/1999 | Pringle | 137/155 |
| 6,109,351 | A | 8/2000 | Beall | |
| 6,237,693 | B1 * | 5/2001 | Deaton | 166/375 |
| 6,427,778 | B1 | 8/2002 | Beall et al. | |
| 6,513,594 | B1 * | 2/2003 | McCalvin et al. | 166/320 |
| 6,557,652 | B2 * | 5/2003 | Klemm | 175/296 |
| 6,866,101 | B2 * | 3/2005 | Sloan | 166/375 |
| 7,392,849 | B2 * | 7/2008 | Lauderdale et al. | 166/375 |
| 2002/0046845 | A1 | 4/2002 | Rayssiguier et al. | |

FOREIGN PATENT DOCUMENTS

| | | |
|---|---|---|
| GB | 2147643 A | 5/1985 |
| GB | 2148979 A | 6/1985 |

(Continued)

OTHER PUBLICATIONS

Millet, Francois, et al., "Improving Well Safety and Maximizing Reserves Using an Innovative Surface Controlled Subsurface Safety Valve", SPE 113829, Sep. 2008, 1-8.

(Continued)

*Primary Examiner*—Daniel P Stephenson
(74) *Attorney, Agent, or Firm*—Steve Rosenblatt

(57) ABSTRACT

A control system for a subsurface safety valve addresses normal open and closed operation and a failsafe operation if key system components fail. It features a single control line from the surface that splits at the subsurface safety valve and goes to one end of two discrete piston chambers that are aligned and isolated from tubing pressure. The piston in one chamber is larger than in the other and the pistons are connected for tandem movement. Each side of the unbalanced system's piston has a seal mounted to it and another for the rod attached to it that exits the chamber. A jumper line connects the chambers at a point between the seals in each chamber and features a large reservoir. The jumper line is filled with a compressible fluid. Fail safe closure of the valve occurs if any of the four seals fail.

29 Claims, 1 Drawing Sheet

FOREIGN PATENT DOCUMENTS

| | | | |
|---|---|---|---|
| GB | 2243634 | A | 11/1991 |
| WO | 03/062595 | A1 | 7/2003 |

OTHER PUBLICATIONS

Abou-Sayed, Omar A., et al., "Development of a Through-Flow-Line (TFL)-Deployed Insert Surface Controlled Subsurface Safety Valve", SPE 62956, Oct. 2000, 1-11.

Afolabi, Folorunso, et al., "Rigless Installation of Safety Valves to Implement a Well-integrity Campaign and Return Wells To Production", SPE 106533, Mar. 2007, 1-7.

Li, L.J., et al., "Improving the Closing Characteristics of Subsurface Safety Valve with Combined FEA and CFD Modeling/Numerical Analysis", SPE 93941, Mar.-Apr. 2008, 1-9.

Bolding, Jeff L., et al., "Resurrecting a Low-Pressure Gas Well Offshore: Through-Tubing Foamer Injection via a Capillary Tubing System and a Specialized WRSCSSV", SPE 110086, Nov. 2007, 1-11.

* cited by examiner

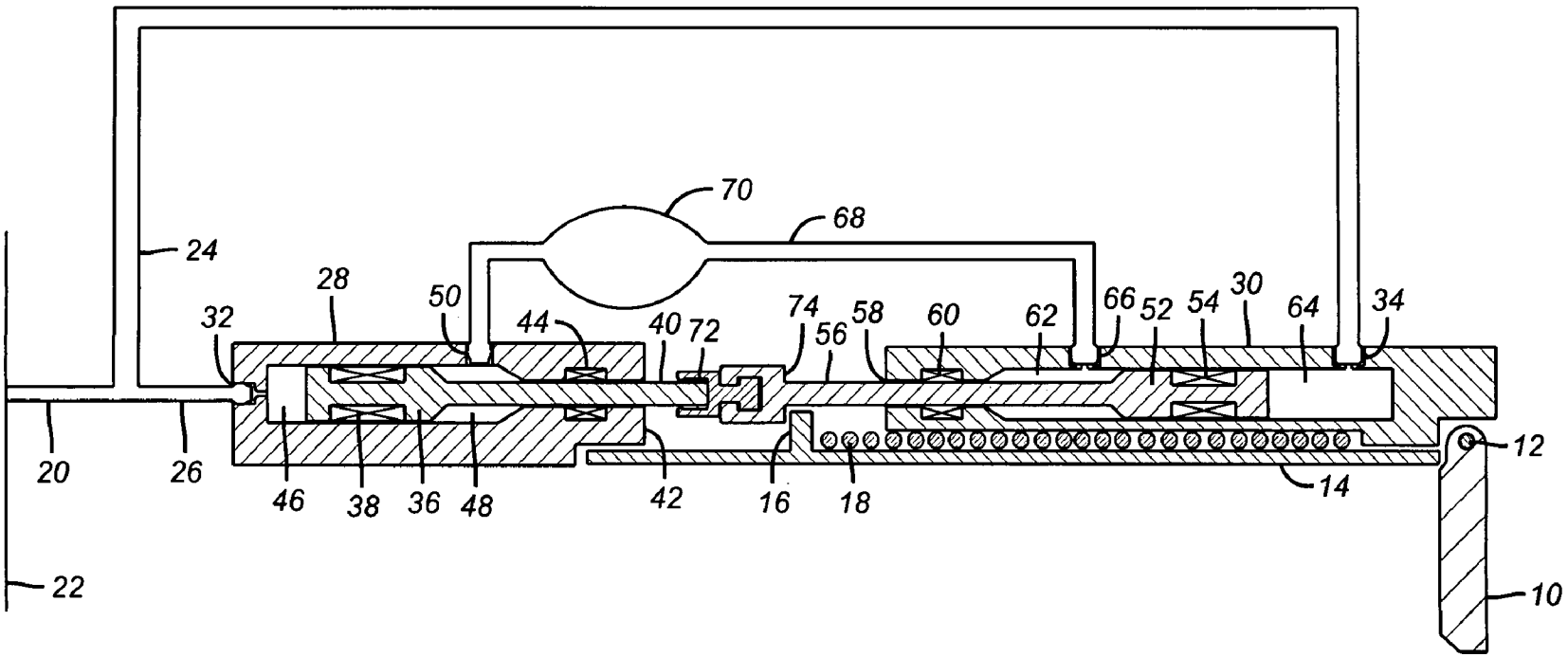
10
12
14
16
18
20
22
24
26
28
30
32
34
36
38
40
42
44
46
48
50
52
54
56
58
60
62
64
66
68
70
72
74

DOWNHOLE HYDRAULIC CONTROL SYSTEM WITH FAILSAFE FEATURES

FIELD OF THE INVENTION

The field of this invention is tubing pressure insensitive control systems for downhole tools such as subsurface safety valves, ball valves, sliding sleeves or packoff tubing hangers, for example, and more particularly features of such systems that allow a safety valve to go to a failsafe mode in the event of component malfunction.

BACKGROUND OF THE INVENTION

Subsurface safety valves are used in wells to close them off in the event of an uncontrolled condition to ensure the safety of surface personnel and prevent property damage and pollution. Typically these valves comprise a flapper, which is the closure element and is pivotally mounted to rotate 90 degrees between an open and a closed position. A hollow tube called a flow tube is actuated downwardly against the flapper to rotate it to a position behind the tube and off its seat. That is the open position. When the flow tube is retracted the flapper is urged by a spring mounted to its pivot rod to rotate to the closed position against a similarly shaped seat.

The flow tube is operated by a hydraulic control system that includes a control line from the surface to one side of a piston. Increasing pressure in the control line moves the piston in one direction and shifts the flow tube with it. This movement occurs against a closure spring that is generally sized to offset the hydrostatic pressure in the control line, friction losses on the piston seals and the weight of the components to be moved in an opposite direction to shift the flow tube up and away from the flapper so that the flapper can swing shut.

Normally, it is desirable to have the flapper go to a closed position in the event of failure modes in the hydraulic control system and during normal operation on loss or removal of control line pressure. The need to meet normal and failure mode requirements in a tubing pressure insensitive control system, particularly in a deep set safety valve application, has presented a challenge in the past. The results represent a variety of approaches that have added complexity to the design by including features to insure the fail safe position is obtained regardless of which seals leak. Some of these systems have overlays of pilot pistons and several pressurized gas reservoirs while others require multiple control lines from the surface in part to offset the pressure from control line hydrostatic pressure. Some recent examples of these efforts can be seen in U.S. Pat. Nos. 6,427,778 and 6,109,351.

Despite these efforts a tubing pressure insensitive control system for deep set safety valves that had greater simplicity, enhanced reliability and lower production cost remained a goal to be accomplished. The present invention introduces a vastly simplified design with fewer leak paths and moving components. It features a single control line to the surface and substantially reduces the effect of control line hydrostatic pressure in a single line with a pair of opposed pistons of differing diameters moving in tandem in separate reservoirs. Control line pressure is on one side of each piston and the opposite sides of each piston are in fluid communication with each other via a compressible fluid in a reservoir, although other types of fluids are envisioned. These and other aspects of the invention will be more readily apparent to those skilled in the art from a review of the description of the preferred embodiment along with the associated drawing with the further understanding that the appended claims fully define the scope of the invention.

SUMMARY OF THE INVENTION

A control system for a subsurface safety valve addresses normal open and closed operation and a failsafe operation if key system components fail. It features a single control line from the surface that splits at the subsurface safety valve and goes to one end of two discrete piston chambers that are, preferably, aligned. The piston in one chamber is larger than in the other and the pistons are connected for tandem movement. Each piston has a seal mounted to it and another for the rod attached to it that exits the chamber. A jumper line connects the chambers at a point between the seals in each chamber and features a reservoir. The jumper line can be filled with a compressible or other fluid. Fail safe closure of the valve occurs if any of the four seals fail.

BRIEF DESCRIPTION OF THE DRAWING

FIG. 1 is a system layout of the control system in the flapper closed position.

DETAILED DESCRIPTION OF THE PREFERRED EMBODIMENT

To aid in focus on the invention the subsurface safety valve will be shown schematically since the focus of the invention is on the control system that operates the valve. What is shown in FIG. 1 is the flapper 10 that pivots on a pin 12. A flow tube 14 has a tab 16 that is contacted to move the flow tube 14 against the flapper 10 to pivot it from the position shown to the open position where it is rotated 90 degrees. In the position shown, the flapper 10 is held against a complementary seat (not shown) by a spring (not shown) usually mounted on pin 12. A closure spring 18 biases tab 16 and with it the flow tube 14 away from the flapper 10 to allow the flapper to rotate 90 degrees to the closed position. Again, these schematically presented components comprise the basic elements of known subsurface safety valves and provide the context for the invention in the associated control system.

The control system's purpose is to operate the flapper 10 between its closed position shown and the open position using some of the previously described stock components to do so. A control line 20 extends from the schematically illustrated surface 22. Line 20 branches into segments 24 and 26. Piston housings 28 and 30 are preferably aligned. Segment 26 extends into inlet 32 on housing 28. Segment 24 extends into inlet 34 on housing 30.

Piston 36 in housing 28 has an upper control chamber seal 38 and a connecting rod 40 that passes through opening 42 and has an upper tubing seal 44. Piston 36 divides its bore into chambers 46 and 48. Chamber 46, the higher pressure chamber, is in fluid communication with inlet 32 while chamber 48, the lower pressure chamber, is in communication with port 50.

Housing 30 has a piston 52 that has a lower control chamber seal 54 and a connecting rod 56. Rod 56 exits housing 30 through opening 58 that is sealed with a lower tubing pressure seal 60. Piston 52 divides housing 30 into chambers 62, the lower pressure chamber, and 64, the higher pressure chamber. Line segment 24 enters chamber 64 through inlet 34. Chamber 62 has a port 66.

Insensitivity to tubing pressure or pressure balance in the context of the combined dimension of the rod 40 and its seal 44 on one hand and the combined dimension of the rod 56 and its seal 60 on the other hand is defined as closeness in their areas that can include an area disparity of as much as 10%.

Ports 50 and 66 are connected by line 68 which further comprises a larger volume reservoir 70. Line 68 and reservoir 70 are preferably filled with a compressible fluid such as air or nitrogen, for example, at the surface, when the components are assembled. Other fluids or fluid types can also be used.

While a coupler 72 could be used, it is not required. Coupler 72 allows easy assembly of rods 40 and 56 to each other. One way to do this is to put a T-shaped end on coupler 72 that can slide into a mating receptacle at the end of rod 56. The other end of the coupler 72 can be threaded or pinned or otherwise secured to rod 40, other examples are but not limited to, ball/socket or u-joint configurations. This feature permits a certain amount of misalignment of rods 40 and 56 consistent with preferred manufacturing tolerances. A more pronounced offset can also be accommodated in rods 40 or 56 or in coupler 72.

In the preferred embodiment, pistons 36 and 52 are rod pistons that are aligned axially to facilitate coupling the rods 40 and 56 to each other. The diameter of piston 36 is larger than the diameter of piston 52 for a reason that will be explained when reviewing the operating procedure and the various failure modes. While rod pistons are preferred, other types of pistons can be used such as annularly shaped pistons, for example. Because the piston diameters are unequal a given movement of the pistons toward the flapper 10 reduces the volume of chamber 48 while the volume of chamber 62 increases. This could result in pressure buildup in these chambers as the compressible fluid in the jumper line 68 has its pressure increased due to volume reduction when the pistons move in a direction toward flapper 10. The addition of the reservoir 70 minimizes this pressure spike that could impede the normal operation of the control system. With the reservoir 70 the volume reduction from piston movement has a negligible pressure buildup in chambers 48 and 62.

Despite the fact that a single control line 20 comes down from the surface 22, the effect of control line hydrostatic pressure is reduced as the same hydrostatic pressure acts downwardly on piston 36 in chamber 46 and upwardly on piston 52 in chamber 64. The required control pressure to open the valve is further reduced since the tubing pressure is balanced given that seals 44 and 60 are of equal size. Thus, it is not necessary for the control pressure to overcome tubing pressure prior to compressing the spring to open the valve. Since pistons 36 and 52 are of different diameters, the net force on them is the hydrostatic pressure acting on the difference of their areas, which difference is quite small, by design. Yet it is this difference in area of the pistons that accounts for the net force when the pressure is elevated in line 20 to shift the pistons toward the flapper 10 so as to open the valve by engaging shoulder 74 on tab 16 and overcoming the force of spring 18. Spring 18 is designed to overcome the hydrostatic net force as explained above and friction in the piston and connecting rod seals as well as the weight of the pistons and their connecting rods and a little more for a safety factor.

Accordingly, to open the flapper 10 a pressure buildup in line 20 overcomes the resistance of spring 18 and shoulder 74 pushes down tab 16 driving the flow tube 14 against the flapper 10 and rotating it 90 degrees and away from its seat (not shown) to a position behind the shifted flow tube 14. To normally close the flapper 10 the pressure in line 20 is reduced to allow the spring 18 to overcome the net force from hydrostatic, friction and weight forces described above so as to drive the flow tube 14 back up which allows the flapper spring (not shown) to rotate the flapper 90 degrees to get to its closed position against its seat (not shown).

Failure modes can happen in one of four ways depending on which of the four seals 38, 44, 60 or 54 starts leaking. If seal 38 leaks pressure in chamber 46 which is control line pressure in line 20, communicates to chamber 48 from chamber 46, putting piston 36 in pressure balance. Chamber 48 also communicates to chamber 62 through jumper line 68. This puts the pressure from branch 26 into chamber 62 and the same pressure from branch 24 into chamber 64. Now piston 52 is in pressure balance. With both pistons in pressure balance, spring 18 closes flapper 10 by shifting up the flow tube 14.

If seal 54 fails the pressure from the control line 20 through branch 24 gets into both chambers 64 and 62 putting piston 52 in pressure balance. Because of jumper line 68 the pressure in chamber 62 is the same as chamber 48. Thus the pressure from branch 24 gets all the way to chamber 48 while the same pressure that is in branch 24 gets to chamber 46 through branch 26. Again, both pistons are in pressure balance and the spring 18 shifts the flow tube 14 upwardly allowing the flapper 10 to rotate 90 degrees to its closed position shown in FIG. 1.

If seal 44 fails tubing pressure will enter chamber 48 and through jumper 68 will also enter chamber 62. If the leak is large enough, even with pressure applied in line 20 a net unbalanced force will be created from having tubing pressure in chambers 48 and 62 until at some point the combination of that unbalanced pressure caused by the size difference in the pistons 36 and 52 will shift the piston upward to the closed position in combination with spring 18 which will cause the flow tube 14 to be moved up to allow the flapper 10 to rotate 90 degrees to its closed position.

If seal 60 fails, tubing pressure will enter both chambers 62 directly and 48 through the jumper line 68. The same result obtains as when seal 44 fails, as described above.

Those skilled in the art will now appreciate that the system provides for failsafe operation in a very simple design. A single control line that splits and connects into high pressure chambers which are isolated from tubing pressure and comprised of opposed pistons of different sizes, allow only a very small net force from control line hydrostatic pressure to exist. This pressure can be simply offset with proper sizing of the return spring 18 that need not be sized to offset full control line hydrostatic pressure and without the need to compensate for the tubing pressure at the valve since the design eliminates this need by balancing the tubing pressure at inner seals 44 and 60. By the same token, the difference in piston sizes allows for opening the flapper with applied pressure in the control line to the point where the unbalanced force on the two pistons is great enough to overcome the force of the return spring 18. The jumper line 68 connects the low pressure chambers 48 and 62 to facilitate tandem movement of pistons 36 and 52 as well as serving as a conduit to equalize pressure across the pistons if seals 38 or 54 fail. If either seal 44 or 60 fails, tubing pressure gets into both low pressure chambers 48 and 62 and by virtue of piston 36 being larger than piston 52 forces both pistons up due to a net unbalanced force acting in that direction and the flapper 10 can close. The reservoir 70 eliminates significant pressure buildup due to a net volume reduction between chambers 48 and 62 as the pistons move to open flapper 10. The large volume of reservoir 70 relative to line 68 and the amount of volume reduction experienced during the flapper opening operation prevents pressure buildup, which, if it occurred, would fight the opening of the valve for the same reason as a leak in seals 44 or 60 would tend to move the control system to the flapper closed position.

While one pair of rod pistons is illustrated, multiple pairs can be used. Wholly or partially annular piston shapes can be used or be combined with rod pistons. Optionally, the tab 16 can be connected directly to rods 40 or 56 for movement of the flow tube in opposed directions.

While the control system is described in context of a subsurface safety valve, it can be used for other downhole tools where the final controlled element differs from a flow tube driven flapper, which is simply a specific execution of the invention. The pistons can move a sleeve or set slips or a packer element, for examples of some final controlled elements.

The above description is illustrative of the preferred embodiment and many modifications may be made by those skilled in the art without departing from the invention whose scope is to be determined from the literal and equivalent scope of the claims below.

We claim:

1. In a downhole tubing mounted tool having a controlled element, the improvement comprising:

a single control line running downhole and branching to selectively deliver control line pressure to opposed ends of at least one pair of pistons connected to each other, said pressure delivered in opposed directions to said pistons from said branching lines and wherein said pistons move at the same time for movement of the controlled element that can be repeated in at least a first direction.

2. The tool of claim 1, wherein:

said pistons move in tandem in a second direction opposite said first direction.

3. The tool of claim 2, wherein:

said pistons are of different sizes.

4. The tool of claim 1, wherein:

said pistons each comprise a piston seal and are disposed in discrete housings configured to put said pistons in pressure balance if either of said piston seals fail.

5. The tool of claim 1, wherein:

said pistons are disposed in discrete housings and further comprise connecting members that extend from the respective housing for connection between said housings.

6. The tool of claim 5, wherein:

said connecting members are aligned and said pistons are of different sizes.

7. The tool of claim 1, wherein:

said tool comprises a subsurface safety valve and said controlled element comprises a biased flow tube movable by said pistons to open a flapper.

8. In a downhole tubing mounted tool having a controlled element, the improvement comprising:

a single control line running downhole and branching to selectively deliver control line pressure to at least one pair of pistons that move in tandem for movement of the controlled element in at least a first direction;

said pistons move in tandem in a second direction opposite said first direction;

said pistons are of different sizes;

said pistons are disposed in discrete housings with each piston having a connecting member extending out of said housing so that the connecting members can be connected outside said housings.

9. The tool of claim 8, wherein:

the larger piston comprises a piston seal and a spaced connecting member seal, said larger piston seal divides a first housing into a large piston higher and a lower pressure chamber and said larger piston connecting member seal excludes tubing pressure from said larger piston lower pressure chamber;

the smaller piston comprises a piston seal and a spaced connecting member seal, said smaller piston ring seal divides a second housing into a smaller piston higher and a lower pressure chamber and said smaller piston connecting member seal excludes tubing pressure from said smaller piston lower pressure chamber.

10. The tool of claim 5, wherein:

said lower pressure chambers are in fluid communication.

11. The tool of claim 10, wherein:

said fluid communication further comprises a reservoir volume sized to reduce pressure buildup from lower pressure chamber volume reduction due to piston movement.

12. The tool of claim 11, wherein:

said reservoir contains a compressible fluid.

13. The tool of claim 10, wherein:

said higher pressure chambers are in fluid communication with said control line.

14. The tool of claim 13, wherein:

failure of either piston seal puts both said pistons in pressure balance to distance said pistons from the controlled element.

15. The tool of claim 13, wherein:

failure of either connecting member seal, causing leakage from the tubing, creates a net force on said pistons from tubing pressure to distance said pistons from the controlled element.

16. The tool of claim 15, wherein:

said net force results from tubing pressure migrating into said lower pressure chambers upon a failure of a connecting member seal.

17. The tool of claim 15, wherein:

said tool comprises a subsurface safety valve and said controlled element comprises a biased flow tube movable by said pistons to open a flapper.

18. The tool of claim 9, wherein:

said tool comprises a subsurface safety valve and said controlled element comprises a biased flow tube movable by said pistons to open a flapper.

19. The tool of claim 8, wherein:

said connecting members are balanced from the effect of tubing pressure.

20. The tool of claim 8, wherein:

said connecting members are unitary outside said housings.

21. The tool of claim 8, wherein:

said connection members are connected by a connection outside said housings.

22. The tool of claim 8, wherein:

said connecting members are either aligned or misaligned.

23. In a downhole tubing mounted tool having a controlled element, the improvement comprising:

a single control line running downhole and branching to selectively deliver control line pressure to at least one pair of pistons that move in tandem for movement of the controlled element in at least a first direction;

said pistons each comprise a piston seal and are disposed in discrete housings configured to put said pistons in pressure balance if either of said piston seals fail;

said pistons are linked through connecting members that extend from each piston and out of said housings, each connecting member further comprising a connecting member seal where a said connecting member exits a housing to exclude tubing pressure, whereupon failure of either of said connecting member seals a net force from tubing pressure acts on said pistons to distance said pistons from said controlled element.

24. The tool of claim 23, wherein:

said pistons are of different sizes.

25. The tool of claim 24, wherein:

each piston divides its housing into a higher pressure chamber in fluid communication with the control line and a lower pressure chamber, said lower pressure chambers in communication with each other.

26. The tool of claim 25, wherein:

said lower pressure chambers contain a compressible fluid at a pressure substantially lower than hydrostatic pressure in said control line.

27. The tool of claim 26, wherein:

said fluid communication between said chambers comprises a reservoir having a larger volume than said lower pressure chambers.

28. The tool of claim 23, wherein:

said tool comprises a subsurface safety valve and said controlled element comprises a biased flow tube movable by said pistons to open a flapper.

29. In a downhole tubing mounted tool having a controlled element, the improvement comprising:

a single control line running downhole and branching to selectively deliver control line pressure to at least one pair of pistons that move in tandem for movement of the controlled element in at least a first direction;

said pistons are in discrete housings and each have one side in fluid communication to said control line and an opposite side pressure balanced to exposure to tubing pressure.

* * * * *

UNITED STATES PATENT AND TRADEMARK OFFICE

CERTIFICATE OF CORRECTION

PATENT NO. : 7,694,742 B2
APPLICATION NO. : 11/522598
DATED : April 13, 2010
INVENTOR(S) : Darren E. Bane et al.

It is certified that error appears in the above-identified patent and that said Letters Patent is hereby corrected as shown below:

In the Claims

At column 6, line 7, please delete "5" and insert therefore -- 9 --.

Signed and Sealed this
Fifteenth Day of October, 2013

Teresa Stanek Rea
*Deputy Director of the United States Patent and Trademark Office*